United States Patent [19]

Florida

[11] 4,358,116

[45] Nov. 9, 1982

[54] GOLF PRACTICE TARGET FOR CHIPPING AND PUTTING

[76] Inventor: John W. Florida, 1549 E. Atherton, Box 11, Flint, Mich. 48507

[21] Appl. No.: 214,705

[22] Filed: Dec. 10, 1980

[51] Int. Cl.[3] ..... A63B 69/36

[52] U.S. Cl. ..... 273/177 R; 273/181 A; 273/407

[58] Field of Search ..... 119/121; 273/181 A, 273/177 R, 177 A, 177 B, 178 R, 178 B, 178 A, 127 R, 127 B, 400, 401, 407

[56] References Cited

U.S. PATENT DOCUMENTS

| | | | |
|---|---|---|---|
| 1,244,357 | 10/1917 | Moore | 119/121 |
| 3,190,657 | 6/1965 | Johnson | 273/181 A |
| 3,190,657 | 6/1965 | Johnson | 273/181 |
| 3,540,734 | 11/1970 | Temple | 273/181 A |
| 3,703,160 | 11/1972 | Biddle | 119/121 |
| 4,017,084 | 4/1977 | Jeffrey | 273/176 FB |
| 4,171,134 | 10/1979 | Reck | 273/181 R |

FOREIGN PATENT DOCUMENTS

| | | | |
|---|---|---|---|
| 922287 | 3/1963 | United Kingdom | 273/177 A |

*Primary Examiner*—George J. Marlo
*Attorney, Agent, or Firm*—Gifford, VanOphem, Sheridan & Sprinkle

[57] ABSTRACT

A target for use by golfers to practice chipping and putting includes a closed loop formed from a length of lightweight rigid tubing and supported by three soil-penetrating support legs. The device may be left outdoors regardless of weather and does not require any maintenance, inflation, or measurement to properly position the device. The support legs of the device are formed so that an offset portion automatically positions the circular tubing of the device to a height proper for allowing a golf ball to pass thereunder. A portion of the leg perpendicular to the offset portion rests substantially along the ground to both stabilize the device and allow for easy setup of the device at the proper height.

8 Claims, 3 Drawing Figures

GOLF PRACTICE TARGET FOR CHIPPING AND PUTTING

BACKGROUND OF THE INVENTION

I. Field of the Invention

The present invention relates to amusement devices, especially golf practice devices for use with regular or practice golf balls.

II. Description of the Prior Art

In the past, golf practice devices have generally been unsuitable for both chipping and putting but have instead been directed to either one or the other of these aspects of the short game in golf. Also, most golf practice devices in the past have included elements which form an obstruction to the normal roll or bounce of the golf ball into the target area such as broad obstructing legs which tend to interfere with the roll of the ball. Finally, most devices in the prior art have been too heavy and have required too many parts for easy assembly, disassembly, and use at a practice location.

Items somewhat similar to the present invention have been developed in the past but they also suffer from various disadvantages now overcome by the present invention. For example, some devices in the prior art have featured inflatable portions so as to conserve space and weight for shipping and other purposes. However, such inflatable portions are subject to rupture, require deflation and reinflation when moved to another location, and also require patching when a rupture occurs. Many times, the damage to such an inflatable item is such that it must be replaced rather than repaired.

Finally, the devices in the prior art have not been easily adjustable to the desired height for chipping and putting either regular or practice golf balls into a target area.

SUMMARY OF THE INVENTION

The apparatus of the present invention is a durable, easily adjustable golf practice device suitable for putting and chipping. Furthermore, the device of the present invention is suitable for use with both regular and practice golf balls. The device is made of relatively sturdy materials not subject to rupture or other breakage requiring repair.

The golf practice device for chipping and putting of the present invention comprises a length of rigid, lightweight, cylindrical tubing in the form of a loop which tubing is supported by at least three specifically designed support legs. The support legs are connected to the loop and are formed of a small diameter rod bent to a predetermined shape. The shape of the rod is such that there is a portion circling the cylindrical tubing, an extending clearance portion of greater length than the diameter of conventional golf balls, a stabilizing portion perpendicular to the clearance portion, and a soil penetration portion offset from, but parallel to, the extending clearance portion.

When the legs of the golf practice apparatus of the present invention are formed in this manner, the cylindrical tubing is supported by a leg extending into the ground directly beneath the center of the tubing to provide adequate support while the clearance portion or the leg is offset to the outermost portion of the cylindrical tubing to provide positioning of the tubing to the proper height above the ground and thereby defining a practice area within the clearance portion of the legs supporting the cylindrical tubing, i.e., the boundary of the practice area is defined below the outside diameter of the circle of tubing.

The present invention represents a significant improvement over the prior art in that the practice device can be properly set up in a short period of time. The legs of the device are inserted into the ground at relatively equidistant portions around the cylindrical tubing. If the soil penetrating portion of each leg is inserted all the way to the transverse stabilizing portion for each leg, the cylindrical tubing will be elevated above the grass or practice area at the proper practice height around the target area. The practice device of the present invention may be easily set up in a matter of a few seconds by even a child so long as the support legs of the invention are merely inserted into the soil so that the stabilizing portion rests on the turf.

Thus, the stabilizing portion of each of the support legs is in a relatively horizontal position when the cylindrical tubing is elevated above the ground in the normal fashion. Furthermore, the stabilizing portions represent an additional support for the cylindrical tubing that will maintain the tubing in its elevated position despite some interference from golf balls which strike the tubing or the legs in flight.

It is also possible to vary the elevation of the tubing above the practice area or terrain so that the space between the tubing and the grass or soil thereunder is less than the diameter of a golf ball. This is especially advantageous where the golfer intends to practice by chipping into the practice area "on the fly" (without relying on a bounce from outside the practice device) over the tubing and into the target area within the circle of tubing. A setup wherein the space between the cylindrical tubing and the grass or soil thereunder is less than the diameter of a golf ball is easily achieved by merely inserting each of the legs at the same relative angle to the vertical. That is, if each of the legs is inserted somewhat outside of the cylindrical tubing at an angle of about 45 degrees from the vertical, then the height of the cylindrical tubing above the target area is lowered somewhat.

It is, therefore, an object of the present invention to provide a golf practice device for chipping and putting wherein the at least three legs of the device are designed so as to facilitate rapid set up of the device for practicing either chipping or putting.

It is also an object of the present invention to provide a sturdy practice device which does not require inflation and is not subject to ruptures that require repair/-patching.

It is also an object of the present invention to provide a readily formed practice device which may be made into a relatively small volume for shipping and storage.

It is also an object of the present invention to provide a golf practice device which may be readily set up at various heights above the practice or target area without the use of measuring devices.

These and other objects of the present invention will be clearly understood by a review of the following drawings when read in conjunction with the subsequent description of the preferred embodiment.

BRIEF DESCRIPTION OF THE DRAWINGS

In the following drawings and description, like reference numerals refer to like characters throughout the description and several views.

DESCRIPTION OF THE PREFERRED EMBODIMENT

Figure 1:
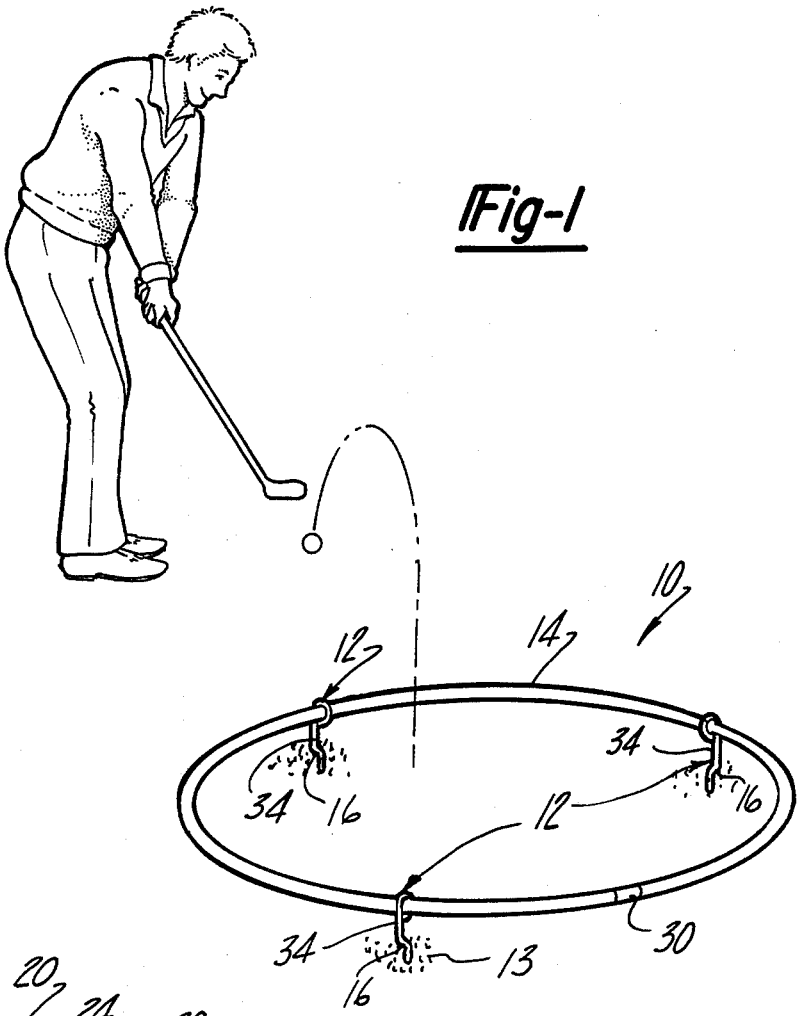
FIG. 1 is a schematic representation of a golfer using the practice device of the present invention with the tubing of the device in the elevated position.

Referring now to FIG. 1, the golf practice device 10 of the present invention is shown in position in a grassy area. Three legs 12 are shown with the soil penetrating portion of each leg 12 inserted in the ground 13. The legs 12 are shown in a relatively upright position so that the cylindrical tubing 14 is at its highest stable position relative to the ground 13. Of course, the tubing 14 could be raised somewhat higher above the ground but then the stabilizing portion 16 of each leg would not be resting on the turf to further stabilize the position of the device.

Figure 2:
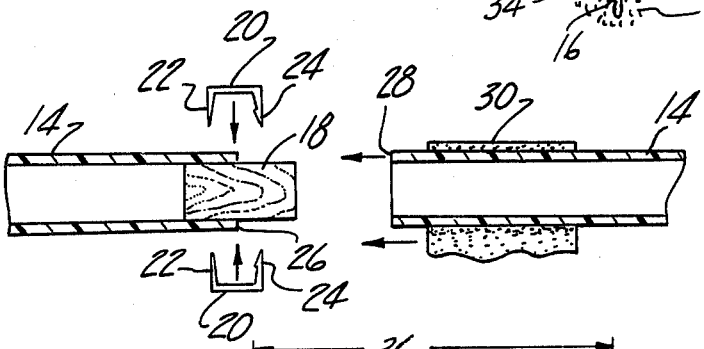
FIG. 2 is a sectional exploded view of the ends of the tubing of the device before the ends are joined.

Referring now to FIG. 2, the cylindrical tubing 14 of the device may be joined at its ends in any of various fashions so long as the juncture is secure. The preferred embodiment shown in FIG. 2 comprises a wooden dowel 18 which has an outside diameter substantially equal to the inside diameter of the tubing 14.

Also shown are two staples 20 which may be driven through the cylindrical tubing so that one prong 22 of each staple 20 penetrates one end 26 of the tubing 14 and the other prong 24 penetrates the other end 28 of the tubing 14. Thus, the tubing 14 is closed over dowel 18 and staples 20 have penetrated the tubing 14 and dowel 18 to join the ends of the tubing 14 to produce a closed loop. Of course, other elements may be used instead of the staples 20 so long as the ends of the tubing 14 are held together thereby.

Finally, as an additional measure to secure the ends of the tubing 14 together around dowel 18, a heat shrinkable sleeve 30 is provided. The sleeve 30 is positioned over one end of the tubing 14, and then slid into position over the ends of the tubing so as to cover the staples 20 and dowel 18. Thereafter, a small amount of heat is applied to the heat shrinkable sleeve 30 so as to shrink the sleeve 30 tightly around both ends 26 and 28 of the tubing 14 so as to cover staples 20.

Alternatively, various kinds of tape may also be used to secure the ends of the tubing together to assure that the means such as staples 20 used to connect the ends do not present a hazard.

Figure 3:
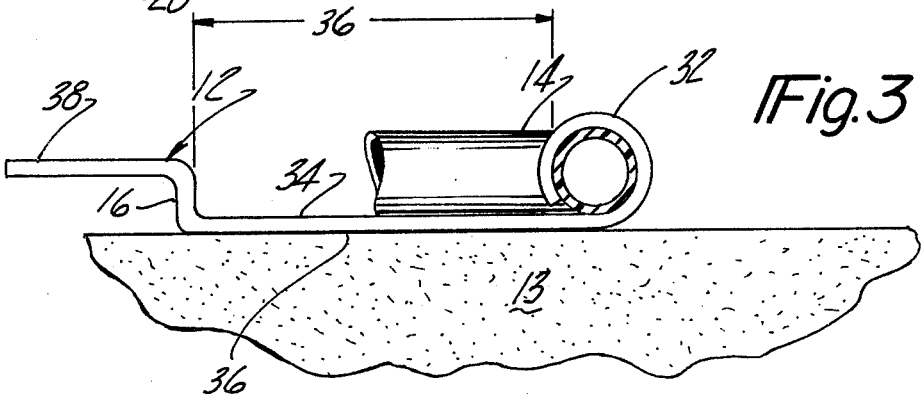
FIG. 3 is a partial sectional view of the supporting leg and tubing of the present invention.

Referring now to FIG. 3, the cylindrical tubing 14 is shown in position above the ground 13. Only one leg 12 is shown in FIG. 3, but it is to be understood that the device should include at least three legs 12. Each leg 12 has an upper closed or loop portion 32 which may be designed to allow free rotation of the leg 12 around tubing 14 or may be designed to frictionally engage the tubing 14. Adjacent the loop portion 32 is a clearance portion 34 which is positioned vertically when the tubing is supported above the ground in a normal manner. Clearance portion 34 is constructed to be of a length 36 greater than the diameter of a golf ball. Thus, when the cylindrical tubing 14 is elevated to its normal position above the ground, a golf ball will roll beneath the tubing without being obstructed thereby.

Adjacent and perpendicular to clearance portion 34 is stabilizing portion 16. Adjacent stabilizing portion 16 is the soil penetration portion or prong 38. Prong 38 is normally pushed all the way into the turf so that the stabilizing portion 16 rests flush against the terrain in the manner shown in FIG. 3.

Of course, the legs 12 of the device may be inserted at an angle to the vertical so that the cylindrical tubing 14 is not elevated as high as clearance portion 34. Thus, the device may be set up so as to prevent a normal diameter golf ball from rolling below the cylindrical tubing 14.

Finally, the device may be laid on the ground with the legs 12 laid in the target area defined by the cylindrical tubing 14. With the legs 12 in this position, the prong 38 of each leg 12 is above the ground and the legs 12 rest on the clearance portions 36. This position of the device may be desirable for chipping over the cylindrical tubing 14 into the target area so as to hold the ball within the target area when it rolls against the cylindrical tubing 14 opposite the spot where it entered.

Although it has been preferred to describe the device of the present invention as a golf practice device, it should be understood that it also has utility as a target to practice casting of fishing baits. The device can be set up in either an elevated or a lowered position and a fisherman can position himself away from the target to attempt to cast a bait into the target area.

From the above description, it is also readily apparent that the various features of the described preferred embodiment may be varied such as by providing equivalent means such as tape rather than a heat shrinkable sleeve or by making other modifications. Thus, it will be apparent to those skilled in the art to which the invention pertains that such modifications are available without deviation from the scope or spirit of the invention as defined by the appended claims.

What is claimed is:

1. A target practice device comprising:

a length of rigid, lightweight, cylindrical tubing of predetermined outside diameter joined at its end to form a closed loop; and at least three support legs, connected to said loop, each of said at least three legs being formed of a small diameter rod and having:

an offset soil-penetrating prong portion at one end of said leg, said prong portion being of sufficient length to stabilize said closed loop above the ground;

a clearance portion parallel to said prong portion;

a stabilizing portion perpendicular to and connecting said prong portion to said clearance portion so that said stabilizing portion rests along the ground when said prong portion is fully inserted into the ground; and a holding portion adjacent said clearance portion at one end of each leg and formed as a ring with a diameter substantially the same as said predetermined outside diameter so as to substantially encircle and hold said tubing such that the tubing may be rotated therein and held at various rotational positions, whereby said offset prong portion of each of said at least three support legs may be inserted into the ground to support said closed loop of tubing above the ground.

2. The practice device as defined in claim 1 wherein said tubing is hollow and has a predetermined inside diameter and further comprising a dowel having an outside diameter substantially the same as said predetermined inside diameter, said dowel being engaged inside said tubing at its ends so as to close the tubing into said loop.

3. The practice device as defined in claim 2 and further comprising at least one staple penetrating said tubing at its ends so as to engage said dowel and secure said loop.

4. The practice device as defined in claim 3 wherein said at least one staple is two staples penetrating said tubing and dowel on opposite sides thereof.

5. The practice device as defined in claim 3 and further comprising tape securing the tubing together at its ends over said dowel.

6. The practice device as defined in claim 3 and further comprising a heat shrinkable sleeve securing the tubing together at its ends over said dowel.

7. The practice device as defined in claim 1 wherein said tubing is plastic.

8. The practice device as defined in claim 1 and wherein said device is intended for use for the practice of chipping and putting a golf ball and wherein said clearance portion is of a greater length than the diameter of said golf ball whereby said golf ball may pass beneath said tubing.

* * * * *